US005899088A

United States Patent [19]

Purdum

[11] Patent Number: 5,899,088

[45] Date of Patent: May 4, 1999

[54] PHASE CHANGE SYSTEM FOR TEMPERATURE CONTROL

[75] Inventor: Howard E. Purdum, Alpharetta, Ga.

[73] Assignee: Throwleigh Technologies, L.L.C., Roswell, Ga.

[21] Appl. No.: 09/078,784

[22] Filed: May 14, 1998

[51] Int. Cl.[6] ..... F25D 3/08

[52] U.S. Cl. ..... 62/371; 62/457.2; 62/530

[58] Field of Search ..... 62/371, 372, 457.1, 62/457.2, 457.7, 529, 530

[56] References Cited

U.S. PATENT DOCUMENTS 2,807,402 9/1957 Nelbach ..... 62/371
4,292,817 10/1981 Loucks ..... 62/457.2
5,115,859 5/1992 Roebelen et al. ..... 165/10
5,270,550 12/1993 Martorana et al. ..... 250/505.1
5,647,226 7/1997 Scaringe et al. ..... 62/457.2

*Primary Examiner*—William Doerrler
*Attorney, Agent, or Firm*—Needle & Rosenberg, P.C.

[57] ABSTRACT

A system and method for maintaining a temperature sensitive payload within a target temperature range, between a minimum temperature and a maximum temperature. Heat transfer devices are provided, having reservoirs for separately containing a first material and a second material, the materials having distinct and separate phase change temperatures which approximately bracket the target temperature range. The latent heats of transformation related to the respective phase changes of the first and second materials resist heating or cooling of the payload above or below the target temperature range.

35 Claims, 6 Drawing Sheets

PHASE CHANGE SYSTEM FOR TEMPERATURE CONTROL

BACKGROUND OF THE INVENTION

1. Field of the Invention

The invention relates to a system and a method for storing and shipping temperature-sensitive materials. In particular, the present invention discloses a system and method suitable for transporting temperature-sensitive products, such as human blood products and pharmaceuticals, within a predetermined temperature range, utilizing at least two temperature control materials having separate phase change temperatures which approximately bracket the target temperature range.

2. Background of the Invention

The conventional means of shipping temperature sensitive materials such as blood and blood products involves the use of an insulated box, with the necessary shipping and warning labels, along with some cooling agent. These cooling agents are typically a frozen gel, dry ice, or glistening (wet) ice.

There are, however, several problems with the conventional approach. First, the styrofoam used for insulation does not degrade readily, leading to disposal problems. These problems are so severe that many countries ban the use of styrofoam, thus severely restricting international shipments of biological materials. Second, the cooling agents also present numerous practical problems in field use. Specifically, gel systems are often too expensive for routine use and disposal. As for dry ice, the carbon dioxide gas evolved during shipment is so dangerous to shipping personnel that hazard warnings must be posted and additional fees paid; furthermore, outright bans on dry ice are pending in several areas. Finally, wet ice poses handling problems in packing, as well as leakage and product soaking problems.

Many previously existing shipping systems also suffer the disadvantage that they are not capable of maintaining the shipped product or payload within a target temperature range. Various biological products, such as platelets, whole blood, semen, organs and tissue, must be maintained above a predetermined minimum temperature and below a predetermined maximum temperature. Pharmaceutical products are also commonly required to be kept within a specified temperature range. Food products, flowers and produce frequently have preferred storage temperature ranges as well. Many known methods and systems for shipping such products are not able to keep temperatures within the desired range. For example, one company ships vaccine packed in dry ice, which sublimes at −78.6° C., even through the specified temperature for storage of the vaccine is approximately −15° C. The result of this practice is excessive cooling, frequently resulting in damage to the vaccine.

Previously known methods and systems which are capable of maintaining a payload within a specified temperature range have been found to be unsuited to certain applications, unduly complex in practice, and/or prohibitively expensive. For example, refrigerated containers require associated compressors, coils, crystals, or other equipment, which adds to the apparatus' expense, weight and size. Additionally, this type of equipment generally requires batteries or connection to an external power source. Refrigerated containers also require ventilation, so that heat from the payload can be rejected to the ambient. Sufficient ventilation for the proper operation of these devices is generally unavailable in the closely-packed cargo compartments of common carrier transport vehicles. Refrigerated transport vehicles exist, but are substantially more expensive than unrefrigerated transport, and are not as readily available.

Another problem often observed with conventional systems is failure to maintain the proper temperature over time, due to inadequate insulation and/or inadequate cooling pack capacity. Again, the end result is product damage.

Yet another problem commonly observed with conventional shipping systems is a strong sensitivity to infrared heat transfer. Specifically, many systems heat rapidly when left in direct sunlight. Part of this susceptibility may be due to the standard industry practice of testing shipping containers only in convective, non-radiative heating systems. While this practice may be appropriate for evaluating shaded or otherwise protected systems, test results obtained in this manner do not accurately anticipate the real world use of shipping containers left indefinitely in direct sunlight on loading docks, etc.

An additional problem is that many insulated storage boxes do not tolerate the condensation that results during conditions of high humidity. Common failures include box collapse due to the dissolution of starch seals, as well as excessive swelling of the box walls themselves.

Finally, the vast majority of shipping systems do not provide uniform temperatures within the container. For example, one system that is currently used to transport blood samples for laboratory analysis consists of a set of frozen gel packs placed on a shelf at the top of a standard RSC (Rigid Shipping Container) cardboard box. Instrumented tests of this system, however, showed that only the samples immediately below the cooling packs were ever in the specified temperature range of 0 to 10° C.; and furthermore, these samples were in this range for only 8 of the required 24 hour test duration, even at a mild ambient temperature of 22° C. Conversely, samples at the bottom of the box were never in the required temperature range, except for approximately 15 minutes after loading from the storage refrigerator. Less severe, but still significant, uniformity problems were also found to affect other shipping systems. Several of these systems showed extreme temperature inversions of 10° C. or more, typically the result of the placement of cooling media only at the top of the shipping system. Again, samples at the bottom of the box never receive adequate cooling. Also, the common failure of shipping personnel to obey "This Side Up" instructions often leads to inadequate cooling of some of the load.

The consequence of these observed shortcomings of conventional shipping systems is damage to the material being transported. For biomedical materials such as blood, blood products, pharmaceuticals, etc., loss of these products due to heat damage is critical because of the intrinsic financial value of these items and because of the potential health hazards that the use of compromised materials presents. Likewise, heat damage to various foods also presents both financial and health consequences. Finally, the loss of flowers and other expensive, heat-sensitive materials presents serious problems to a variety of industries. Because all of the above industries currently experience substantial shipping losses, the commercial opportunity of the present invention is immense.

SUMMARY OF THE INVENTION

Briefly described, in a preferred form, the present invention provides a system and method for maintaining a payload within a temperature range, between a minimum temperature and a maximum temperature. The invention includes a first temperature control material having a first phase change temperature of approximately the minimum temperature in the range, and a second temperature control material having a second phase change temperature of approximately the maximum temperature in the range. In one embodiment, the first material exists as a liquid within the target temperature range, and the second material as a solid. The first material changes from its liquid phase to its solid phase at approximately the minimum temperature in the range, and the second material changes from its solid phase to its liquid phase at approximately the maximum temperature in the range. In this manner, the latent heats associated with the respective phase changes assist in maintaining the temperature of the payload within the range, as is more fully discussed below. Virtually any desired target temperature range may be accommodated by appropriate selection of the first and second materials.

A further embodiment of the present invention provides an insulating container having an outer housing with a cavity therein, and an inner product carrying container for receiving the payload. The inner product carrying container is capable of being disposed within the cavity of the outer housing, thereby forming a "box-within-a-box" structure. Such a container is described in International Patent Application PCT/US96/16243, which description is incorporated herein by reference. The two-material phase change system described above for maintaining temperatures within a range can be incorporated into such a container. One or more heat transfer devices containing a quantity of the first material, and one or more heat transfer devices containing a quantity of the second material are placed between the outer housing and the inner product carrying container. Insulation can be provided between the outer housing and the inner product carrying container, and/or on one or both of the housing and the product carrying container. Thermal inertia elements, as more fully described below, can also be placed in the product carrying container along with the payload, for maintaining the temperature within the range.

The present invention further includes heat transfer devices which can take any of a number of forms, including without limitation: flexible plastic pouches, rigid or semi-rigid panels, and/or blister packs. The heat transfer devices comprise one or more reservoirs for containing the first and second materials. Separate heat transfer devices can be provided for each of the first and second materials or, alternatively, a single heat transfer device can be segmented into separate reservoirs for each of the first and second materials. Baffles or other separation means can be provided within the heat transfer devices for maintaining the first and second materials in position.

One embodiment of a heat transfer device that can be incorporated into the system and method of the present invention comprises a reservoir-defining element having a channel therethrough which is in communication with the cavity in the outer housing, and which is disposed on the element substantially in the direction of the flow of air through the cavity. Such an element is described in International Patent Application PCT/US96/16243, which description is incorporated herein by reference. Each element further comprises one or more reservoirs for containing phase materials, namely the first material or the second material, which have preselected phase change temperatures. Each element is generally configured as a trigonally pyramidal corner-shaped element having an inner surface forming a void generally shaped to receive a corner of the inner product carrying container, and an outer surface shaped to be received within the outer housing. Eight such elements can be disposed in the eight corners of a cube-shaped container system. In this manner, the heat transfer device holds the inner product carrying container securely in place within the outer housing, thereby serving to protect the payload, and places the reservoirs containing the first and second materials proximal the corners of the inner product carrying container, where the rate of heat transfer is typically the greatest.

In a further embodiment, the present invention comprises a method for controlling the temperature of a payload within a temperature range, between a minimum temperature and a maximum temperature. The method entails placing a first material having a first phase change temperature of approximately the minimum temperature in thermal contact with the payload, and placing a second material having a second phase change temperature of approximately the maximum temperature in thermal contact with the payload. This method can be implemented, for example, through the use of one or more of the above-described systems, and will be further described below.

DETAILED DESCRIPTION OF THE PREFERRED EMBODIMENTS

Figure 1:
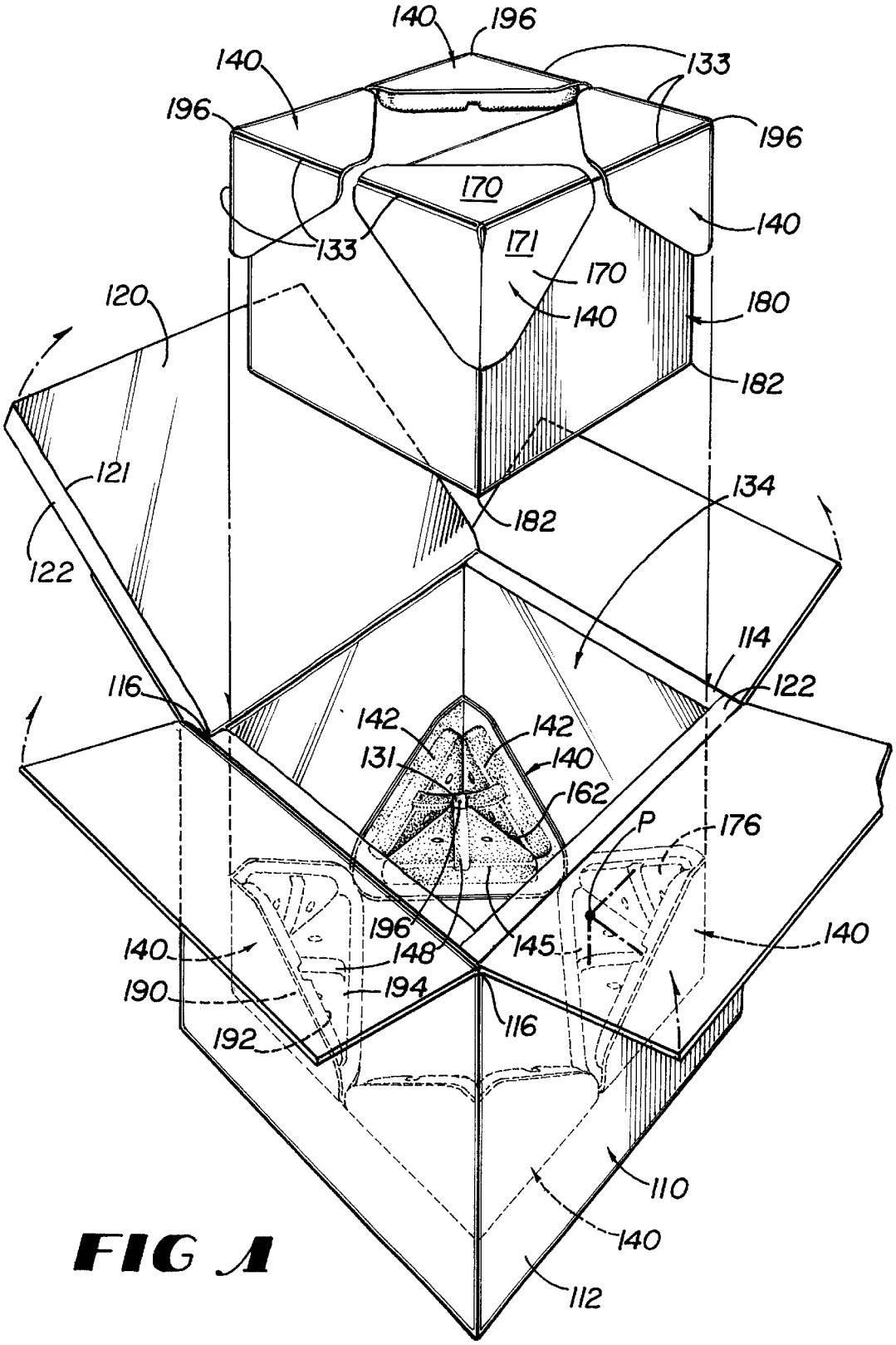
FIG. 1 is a perspective view of a dual containment insulating container according to the present invention.

Referring now in detail to the drawing figures wherein like reference numbers represent like parts throughout, the present invention provides a system and method for maintaining a payload within a predetermined temperature range (sometimes referred to herein as the "target range"). It is presently anticipated that the system and method of the present invention may find application in a wide array of uses with many different types of payloads. For example, the system and method of the present invention can be utilized in the temperature-controlled storage and shipment of payloads including biological materials, pharmaceuticals, food and beverage products, animals, plants, flowers, and virtually any other product or material which is adversely affected by exposure to temperature extremes below a minimum temperature or above a maximum temperature, or which is positively affected by temperature control within a specified range.

The system of the present invention preferably generally comprises at least two temperature control materials having distinct and separate phase change temperatures. The terms "phase" and "state" are used interchangeably herein to refer to any of the physical forms of matter, including solid, liquid and gaseous. The terms "phase change," "state change," or variations thereof, are used interchangeably herein to refer to any change of a quantity of matter from one phase to another, including: freezing (liquid to solid); fusion or melting (solid to liquid); evaporation (liquid to gaseous); condensation (gaseous to liquid); sublimation (solid to gaseous or gaseous to solid); and changes in crystalline form. In a preferred form, the present invention comprises a first material having a first phase change temperature of approximately the minimum temperature of the temperature range within which it is desired to maintain the payload, and a second material having a second phase change temperature of approximately the maximum temperature of the range.

By "bracketing" the target temperature range between the phase change temperatures of the two materials, the latent heat of transformation associated with each material's phase change is advantageously utilized to maintain the temperature of the payload within the target temperature range. This advantage of the present invention may be more easily understood by way of the following example. In the example embodiment, at temperatures within the target temperature range, the first material exists as a liquid and the second material as a solid. The first material is selected to change between its liquid and solid states at a first phase change temperature of approximately the minimum temperature within the range, and the second material is selected to change between its solid and liquid phases at a second phase change temperature of approximately the maximum temperature. When not in use, the first and second materials can be stored at a temperature within the target range, preferably near the midpoint of the range. When placed into service, one or more heat transfer devices incorporating quantities of both the first and the second material are placed into thermal contact with the payload. The term "thermal contact" is intended to comprehend any arrangement allowing heat transfer between the payload and the first and second materials, including heat transfer across an insulating barrier. The heat transfer devices function to maintain the temperature of the payload within the target range by insulating the payload from the ambient, and by controlling the heat flow between the ambient and the payload. So long as the temperature of the system remains between the first and second phase change temperatures, as heat is added to or removed from the system, the first and second materials help to resist temperature change according to known principles of heat transfer, depending upon the respective mass and specific heats of the materials. *Marks' Standard Handbook for Mechanical Engineers* (8th ed.), 4–8 to 4–11. Upon cooling the system to the first phase change temperature, the first material will begin to change from a liquid phase to a solid phase, releasing latent heat while maintaining a substantially constant temperature. Id. at 4–11. On the other hand, when the system is heated to the second phase change temperature, the second material will change from its solid phase to its liquid phase, absorbing latent heat at a substantially constant temperature. In this manner, the system of the present invention resists temperature change beyond the target range due to the latent heat effects resulting from the phase changes of the first and second materials.

Although the above example describes resistance to temperature fluctuations outside of a given range due to latent heats involved in changes between the solid and liquid phases of materials, the present invention also comprehends embodiments wherein the latent heat involved in any phase change of a material is advantageously utilized in maintaining the temperature of a payload within a target range. Also, the term "phase change temperature" is intended to also comprehend materials which change phase over a limited temperature range, rather than at one precise temperature. Additionally, although the example embodiments are described herein as including first and second phase change materials, it will be understood that systems and methods incorporating three or more phase change materials are within the scope of the present invention. For example, a third material could be provided, having a phase change temperature at the approximate midpoint of the target range. Similarly, four phase change materials, having a distinctly spaced range of phase change temperatures ($T_1<T_2<T_3<T_4$), could be incorporated to provide a system and method having an inner range ($T_2<T_{inner}<T_3$) and an outer range ($T_1<T_{outer}<T_4$)

Describing the first and second phase change temperatures as "approximately" the minimum and maximum of the target temperature range is intended to mean that the phase change temperature can be equal to or incrementally above or below the particular endpoint of the target temperature range under consideration, within limitations imposed by the specific application. Such limitations may include, for example: the degree of insulation between the payload, the first and second materials, and the ambient; the payload's susceptibility to damage by temperatures just outside the temperature range; the range of expected ambient temperatures relative to the target payload temperature range; and the specific heats and latent heats of phase change for the first and second materials and the payload. For example, in certain applications wherein the payload is contained in an insulated container which provides an insulating barrier between the payload and the first and second materials, such as is more fully described below, it has been found desirable to select the first material to have a phase change temperature somewhat below the minimum temperature, and the second material to have a phase change temperature somewhat above the maximum temperature. Because the insulated container is interposed between the payload and the first and second materials, the temperature of the payload is maintained within the range for some period of time after the temperature of the first and second materials falls below or exceeds the range. This assures that the entire quantity of the first or second material has completed its phase change prior to the payload temperature falling below or exceeding the temperature range. In this manner, the duration of temperature control is maximized. In other applications, it may be desirable to select the first material to have a phase change temperature somewhat above the minimum temperature and the second material to have a phase change temperature somewhat below the maximum temperature. For example, in applications lacking substantial insulation between the payload and the first and second materials, such as when heat transfer devices containing the first and second material are interspersed directly within the payload, it may be preferable for the first or second material to complete its phase change before the payload temperature reaches the endpoints of the desired range. This ensures receiving the fill heat transfer advantage of the latent heat associated with the phase change prior to the payload temperature falling below or exceeding the range. Specific examples are set forth herein for illustration, and are not intended to be limiting.

The first and second materials can be any materials having phase change temperatures corresponding to the target temperature range, and otherwise compatible with practical requirements of a given application. For example, various organic and inorganic materials, and mixtures thereof, have been found to provide satisfactory results for selected applications. Likewise, different types or grades (e.g., having different levels of impurities) of the same material, or different mixtures of two or more materials, can be used as both the first and the second material so long as the phase change temperatures are different. Furthermore, the normal phase change temperatures of materials can be altered to meet specific requirements by the addition of one or more additives or impurities to form a solution having different phase change characteristics. Factors to be considered in choosing materials for specific applications may include toxicity, reactivity with potential payload materials and/or container materials, weight, thermal expansion characteristics, appearance, odor, viscosity, flammability, etc. Example materials for particular applications are described below.

EXAMPLE 1

Platelets. Liquid Blood, Tissue

The desired temperature range for the storage and transport of platelets, liquid blood (including for platelet extraction purposes), and biological tissue is 20–24° C. Acceptable results have been obtained utilizing a first material having a first phase change temperature of between 16–20° C., and a second material having a second phase change temperature of between 24–26° C. These phase change temperatures can be achieved utilizing n-hexadecane as the first material, and n-octadecane mixed with approximately 5% n-hexadecane as the second material. Other materials or combinations of materials having phase change temperatures in the desired ranges may be utilized as well. Once informed of the desired phase change temperature, the selection of the particular material(s) will be readily determinable by those of ordinary skill in the art from tabulated information and/or from routine experimentation.

EXAMPLE 2

Pharmaceuticals

The desired temperature range for the storage and transport of pharmaceuticals, and for liquid blood not to be used for platelet extraction, is 4–6° C. Acceptable results can be obtained utilizing a first material having a first phase change temperature of between 2–4° C., and a second material having a second phase change temperature of between 6–8° C. These phase change temperatures can be achieved utilizing a variety of materials or combinations of materials having phase change temperatures in the desired ranges. Once informed of the desired phase change temperature, the selection of the particular material(s) will be readily determinable by those of ordinary skill in the art from tabulated information and/or from routine experimentation.

EXAMPLE 3

Semen

The desired temperature range for the storage and transport of semen is between approximately 17–19° C. Acceptable results have been obtained utilizing a first material having a first phase change temperature of between approximately 14–17° C., and a second material having a second phase change temperature of between approximately 19–22° C. These phase change temperatures can be achieved utilizing n-hexadecane as the first material, and n-tetradecane as the second material. Other materials or combinations of materials having phase change temperatures in the desired ranges may be utilized as well. Once informed of the desired phase change temperature, the selection of the particular material(s) will be readily determinable by those of ordinary skill in the art from tabulated information and/or from routine experimentation.

The present invention enables heat transfer devices containing both the first and second materials to be stored together, at a single temperature within the target range, when not in use. In the past, temperature control systems which utilized separate "hot" and "cold" heat transfer devices required storage or preparation of the devices at different temperatures. For example, the "hot" devices might require preparation for use in a warm water bath or an oven, while the "cold" devices were prepared for use in a refrigerator or cold water bath. The present invention eliminates the need for separate storage and/or preparation of its heat transfer devices, thereby reducing preparation time and corresponding expenses of preparation, as well as reducing the amount of equipment and/or storage space required. For many applications, the eventual payload material is stored in bulk quantity in a temperature-controlled facility, from which facility containers of the payload material are shipped in insulated containers, via a distribution system, to various destinations. This temperature-controlled storage facility is typically maintained near the midpoint of the target temperature range, and provides an acceptable location for the storage of the heat transfer devices containing the first and second materials. No preparation of the heat transfer devices is needed, as they are simply packed with the payload at the storage temperature.

Because the present invention allows the first and second materials to be placed in use at the same or substantially the same temperature, the payload is not in thermal contact with separate "hot" and "cold" packs of different temperatures. This eliminates the potential for undesired localized temperature gradients within the payload due to differences in the temperatures of the heat transfer devices placed in contact with different portions of the payload. Also, because both the first and second materials of the present invention can be applied at the approximate midpoint of the target temperature range, the payload is not initially subjected to potentially damaging localized contact with heat transfer devices outside of, or near the extrema of, the target temperature range.

Figure 2:
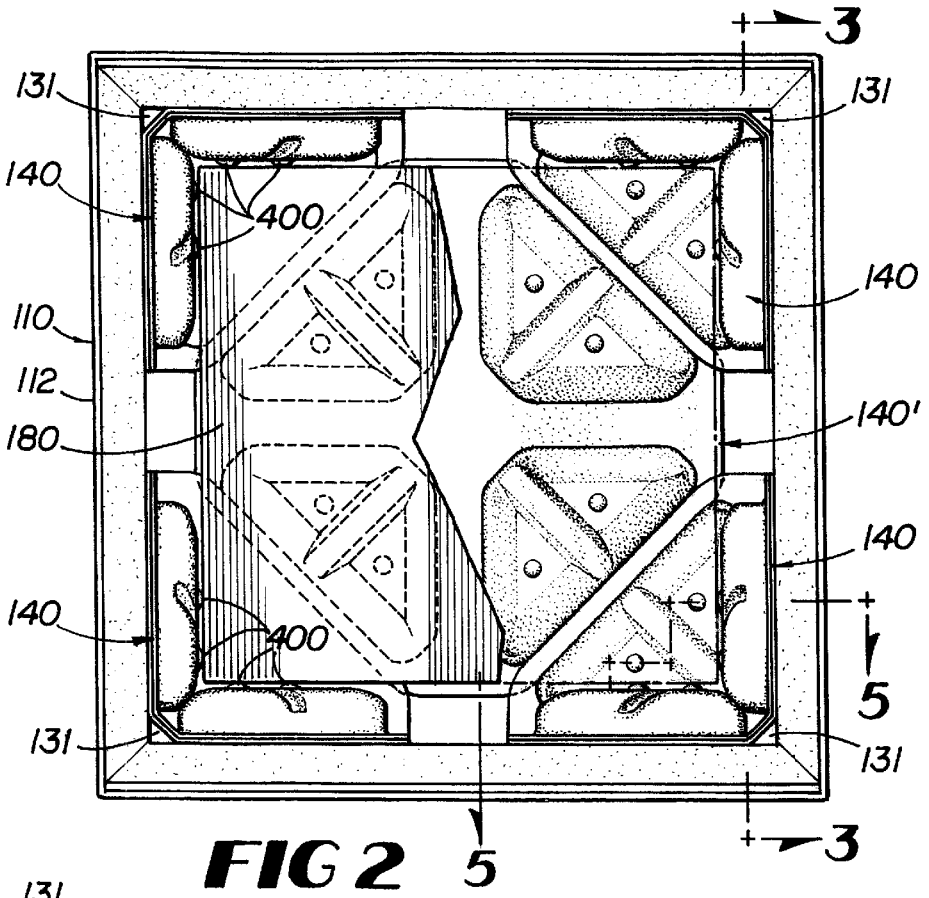
FIG. 2 is a top plan view of a container according to the present invention.
Figure 3:
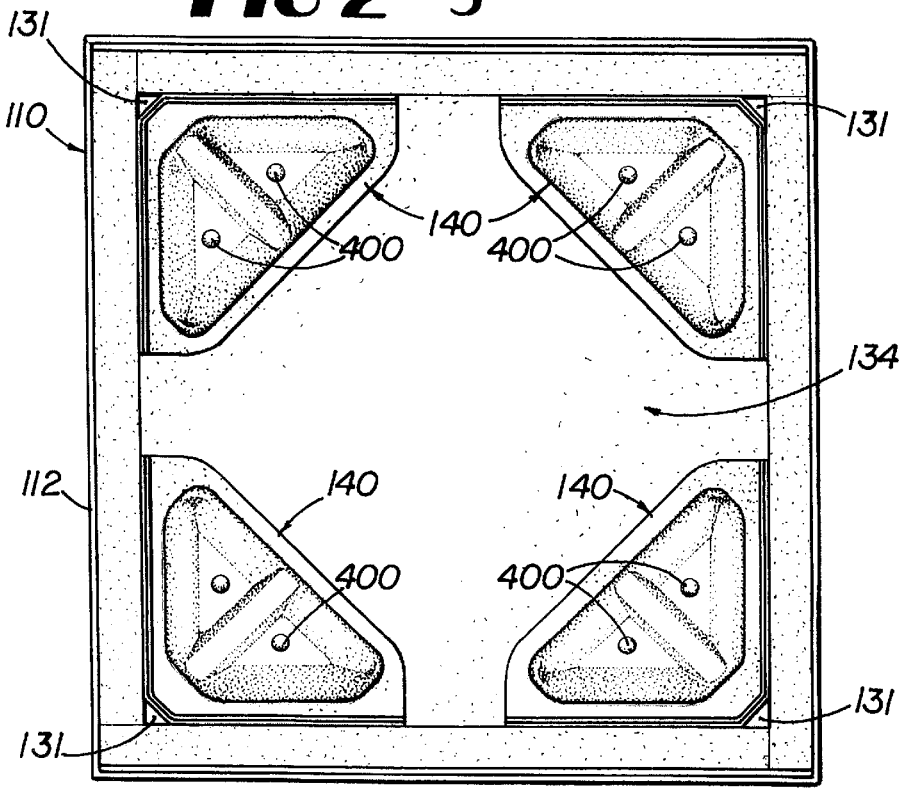
FIG. 3 is a top plan view of a container according to the present invention.

The system and method of the present invention can be practiced simply by placing one or more heat transfer devices having reservoirs separately containing the first and second materials in thermal contact with the payload. In preferred form, however, the present invention further comprises an insulated container for use with the above described system and method. Example embodiments of insulated containers for use with the present invention are depicted in FIGS. 1–3. As shown, the insulated container preferably comprises a reclosable, insulated outer housing 110 defining a cavity 134 therein, an inner product carrying container 180 capable of being disposed within the cavity 134 for receiving the payload, and one or more heat transfer devices 140 as more fully described herein. The insulated outer housing 110 and the inner product carrying container 180 form a "box-within-a-box" double-insulating system, which provides greatly improved efficiency, as more fully explained below.

In a further preferred embodiment, the outer housing 110 can comprise a box formed as a conventional B-flute ("flute"

refers to the size of the convoluted center section of a cardboard box; "B" in particular designates the standard, approximately 2 mm section thickness commonly used for medium-sized boxes) rigid shipping container ("RSC"). The box can further be provided with a durable outer layer 112 for wear resistance, and an insulating inner layer 120. The outer layer 112 of the housing 110 preferably is substantially fluid impermeable, and can be coated with an energy reflective material. The box also may have an inner wax layer to prevent condensation damage to the walls, as well as stitched seals to prevent seam failure due to condensation. When properly taped, the box also provides leak resistance. Alternatively or additionally, the box can be provided with one or more leak-resistant liners, and/or absorbent materials to absorb and contain any condensation or leaks. The insulating inner layer 120 can comprise vacuum insulation such as VacuPanel, manufactured by VacuPanel, Inc., spun rock, styrofoam, or other suitable insulating material.

The inner product carrying container 180, can comprise a RSC similar to the outer housing 110, and is preferably shielded against condensation damage and leakproofed. The outer dimensions of the inner product carrying container 180 are selected to fit within the outer housing 110 with sufficient clearance to allow insertion of the heat transfer devices therebetween. In preferred form, the inner product carrying container 180, the outer housing 110, and the heat transfer devices are configured to form air circulation paths such as channels 131, which encourage the circulation of temperature controlled air in the space between the inner product carrying container 180 and the outer housing 110, resulting in a more uniform temperature control. The inner product carrying container 180 insulates against heat transfer between the payload inside the inner product carrying container 180, and the heat transfer devices and circulating air outside the inner product carrying container 180. Thus, even if the heat transfer devices are heated or cooled beyond the target temperature range, the inner product carrying container 180 serves as a buffer between the payload and the heat transfer devices, thereby maintaining the payload within the target temperature for a period of time. Also, because the outermost material in the heat transfer devices is more directly affected by heat transfer from the ambient than is material in the heat transfer devices toward the inner product carrying container 180, the phase change of the first and second materials will progress from the outside of the heat transfer devices inwardly towards the payload. The interposition of the insulating inner product carrying container 180 between the payload and the heat transfer devices helps to insure that the entire quantity of first or second material contained in the heat transfer device changes phase before the payload is placed in thermal contact, through the insulating inner product carrying container 180, with material outside of the target temperature range.

In preferred form, the present invention further comprises one or more heat transfer devices for separately containing quantities of the first material and/or of the second material. Separate heat transfer devices can be provided for containing the first and second materials or, alternatively, separate reservoirs can be provided in a single heat transfer device for containing both the first and second materials. The heat transfer devices of the present invention can comprise any of a number of physical embodiments. For example, a flexible pouch or pocket, formed from materials such as plastic or rubber, can contain a quantity of the first material or the second material. Similarly, rigid or semirigid elements having sealable chambers for containing a quantity of the first or second material can be provided. Blister packs having one or more chambers formed therein for containing quantities of the first or second materials can also be utilized. The one or more heat transfer devices are preferably fabricated from a material of sufficient durability to withstand the handling and thermal stresses which will result from their repeated use, and which enables sufficient heat transfer to and from the quantity of first or second material therein.

Figure 8:
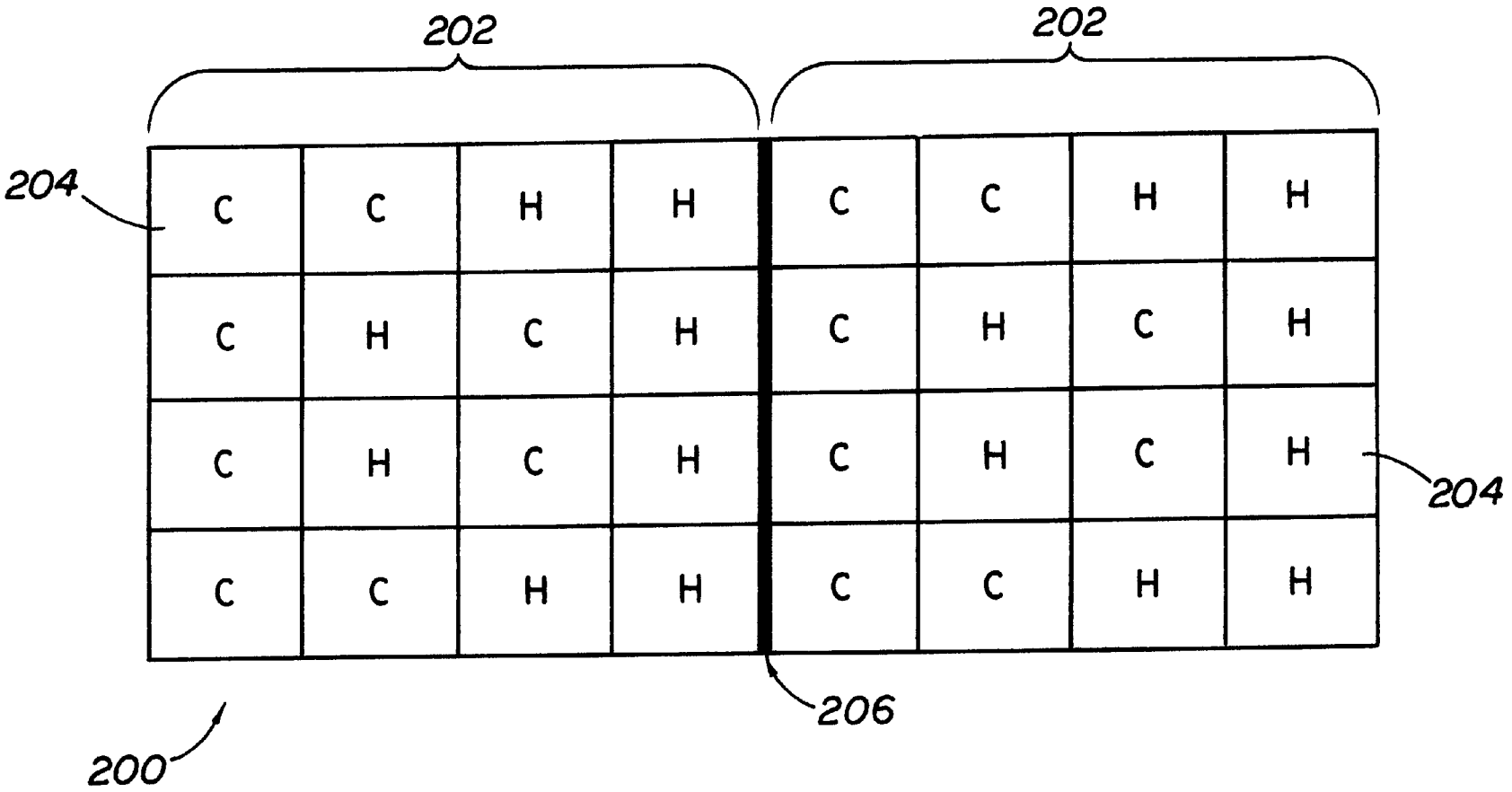
FIG. 8 shows a plan view of a segmented panel layout of a heat transfer device according to the present invention.

One possible embodiment of the heat transfer device of the present invention is shown by FIG. 8. As depicted, the heat transfer device 200 comprises one or more panels 202, each panel comprising one or more separate reservoirs 204. In the embodiment of FIG. 11, for example, two panels 202, each having sixteen reservoirs 204, are shown. Each reservoir 204 separately contains a quantity of the first material or the second material. Those reservoirs 204 containing the first material are designated as "C" and those containing the second material are designated as "H." The panels 202 can be folded about a fold line 206, so that each panel 202 can be placed over one side of the inner product carrying container 180. In this manner, three heat transfer devices 200, having two panels 202 each, can be utilized to cover a six-sided box forming the inner product carrying container 180. Alternate embodiments, such as six-panel, three-panel or single-panel heat transfer devices 200 are possible as well. The panels 202 can be provided with attachment means (unshown), for attaching the panels 202 to one another, and/or for attaching the panels 202 to the inner product carrying container 180 or the outer housing 110. In an alternate embodiment, the reservoirs 204 comprise tubes for separately containing quantities of the first or second material. Panels having multiple tubular reservoirs can also be provided.

Another possible embodiment of the heat transfer device of the present invention, depicted in detail by FIGS. 1–7, 9 and 10, is the rigid or semirigid temperature control element 140, 140'. The temperature control element can be formed as a cornerpiece 140', as seen best in FIGS. 1, 4A, 5, 9 and 10, or as a face area temperature control element 140', as shown in FIG. 4B. The temperature control elements 140, 140' are preferably formed from polystyrene or any similar, rigid or semirigid plastic to ensure low temperature strength and the ability of the pack to maintain its shape after the temperature control material melts. The temperature control elements 140, 140' preferably comprise one or more means 141 for separately containing quantities of the first and/or second materials described above. The containing means 141 form reservoirs or chambers, each of which are filled with one of the first or second materials.

The cornerpieces 140 preferably comprise three generally triangular sub-sections which, when folded, meet to form a three-faced, generally pyramidal member having an inner surface and an outer surface. The inner surface preferably defines a void to receive a corner of the inner product carrying container 180, as shown in FIGS. 1 and 2. One or more cornerpieces 140 can be placed between the inner product carrying container 180 and the outer housing 110. Preferably eight of these pyramids are installed on the eight corners of the inner product carrying container 180. The placement of the temperature control elements on the box corners ensures that the maximum cooling power is applied at the point of maximum heat transfer. The physical basis of this arrangement follows from the common observation that the corners of ice cubes melt before the side walls, due to the greater surface area per unit volume at the corners versus the walls. The placement of a temperature control element at each corner ensures uniformity throughout the volume. This uniformity is thus further ensured regardless of the position of the box, thereby eliminating the problem of incorrect handling by shipping personnel. The outer surfaces of the cornerpieces 140 are preferably shaped to engage the interior of the outer housing 110, securing the inner product carrying container 180 in place to prevent shifting of the payload and to protect the payload from external impacts.

Figure 9:
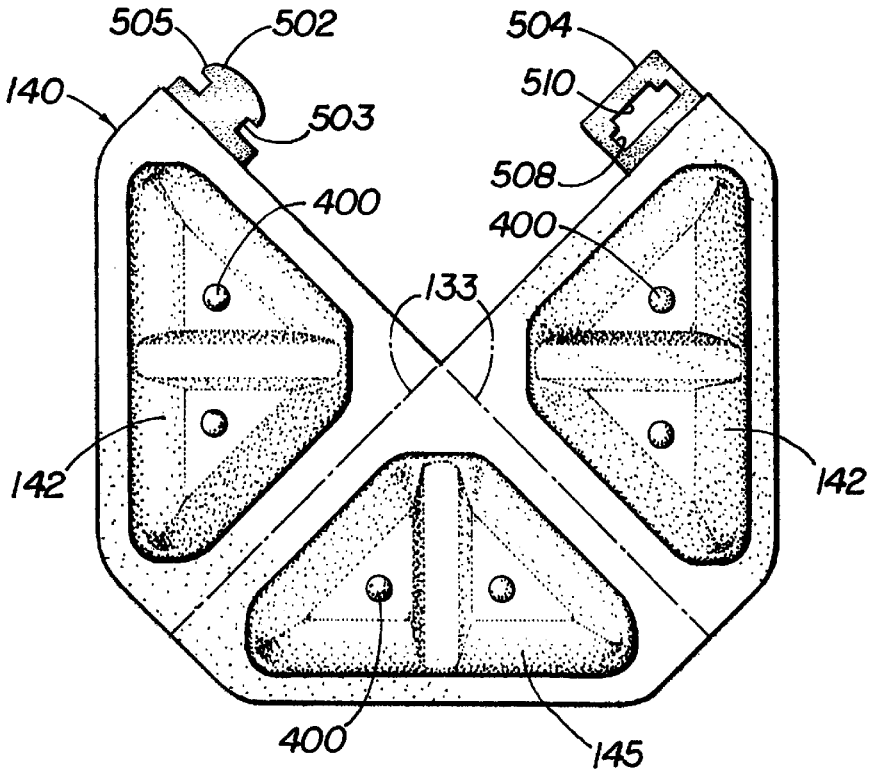
FIG. 9 shows a top plan view of a cornerpiece heat transfer device according to the present invention.
Figure 10:
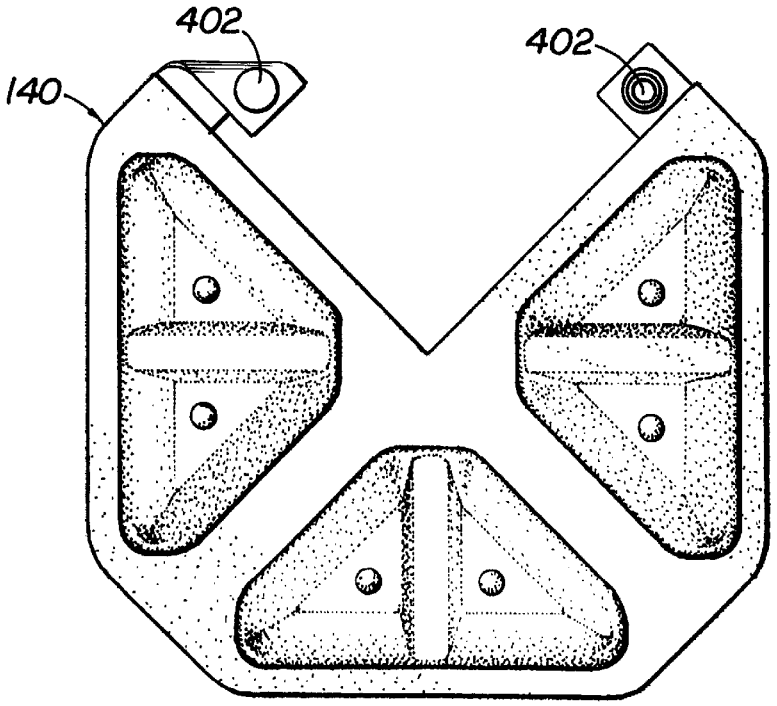
FIG. 10 shows a top plan view of another cornerpiece heat transfer device according to the present invention.

In a further embodiment, the cornerpieces 140 can comprise connection means for joining the three generally triangular sub-sections to form a generally pyramidal member. As shown in FIG. 9, the connection means can comprise a male member 502 and an opposed female interlocking member 504, wherein the male member 502 has a shaft portion 503 of a first selected width and a retention portion 505 of a second selected width which is greater than the first selected width and wherein the female member 504 defines a first slot 508 of a third selected width capable of receiving therethrough the portion 505 of the male member 502 having the second selected width and a second slot 510 of a fourth selected width, smaller than the third selected width and fisher capable of receiving the shaft portion 503 therein, whereby upon operation the male and female portions 502 and 504 interconnect to removably connect the non-intermediate members 142. Alternatively, a snap closure mechanism 402, as shown in FIG. 10, or other connection means, can be utilized.

Figure 4A:
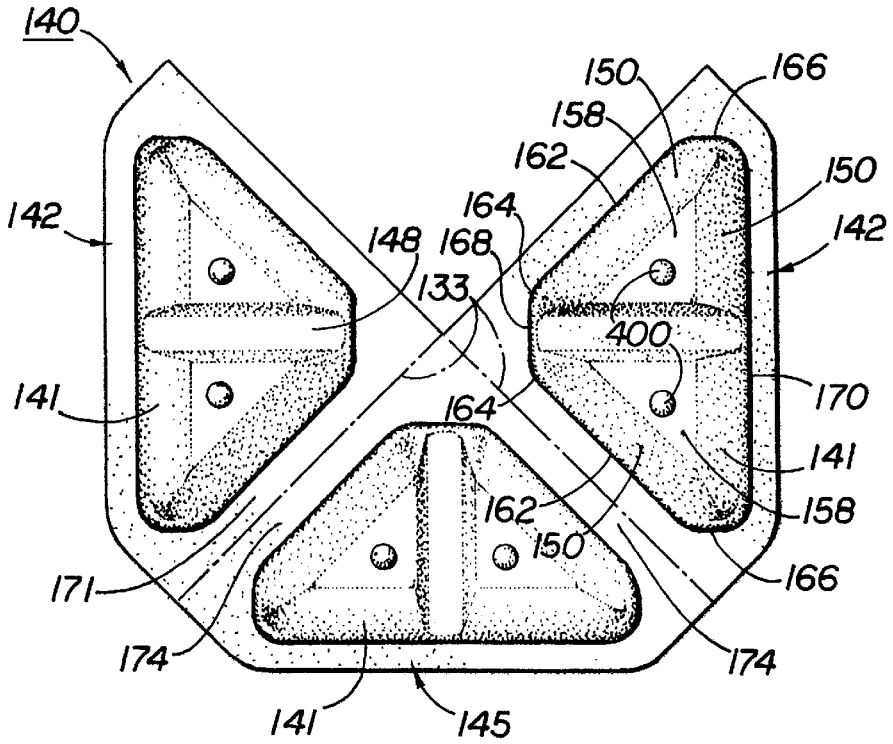
FIG. 4A is a top plan view of a corner piece heat transfer device according to the present invention.
Figure 4B:
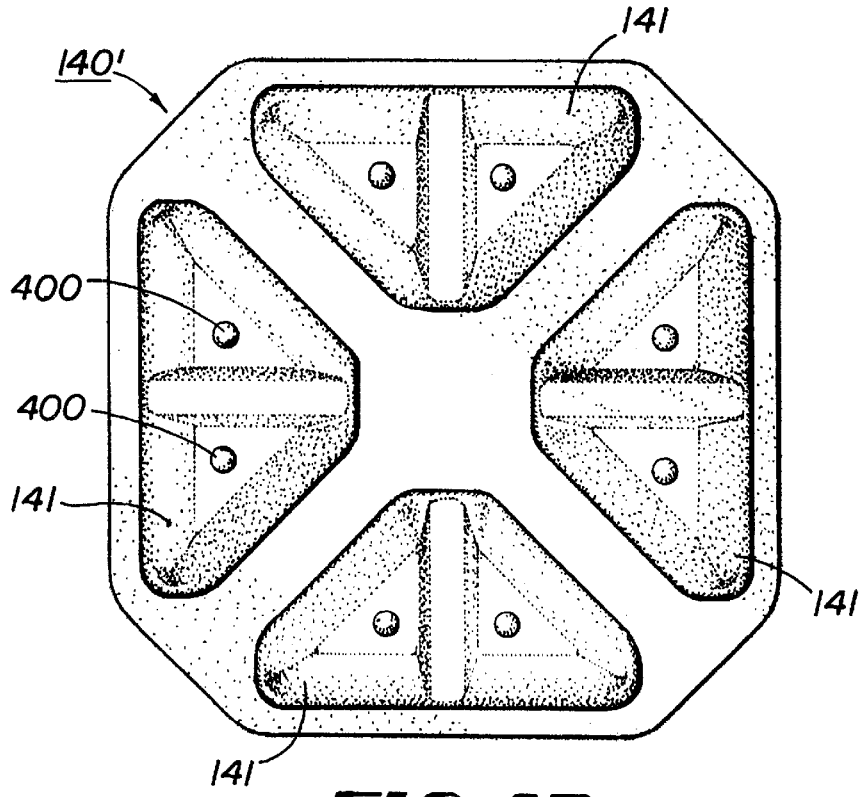
FIG. 4B is a top plan view of another heat transfer device according to the present invention.
Figure 5:
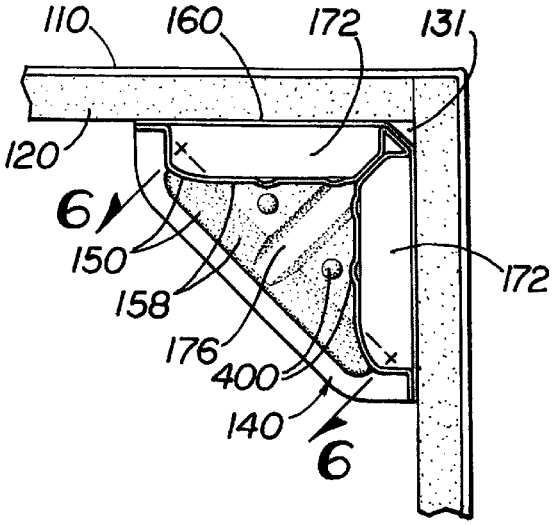
FIG. 5 is a top plan view of a corner piece heat transfer device in situ according to the present invention.
Figure 6:
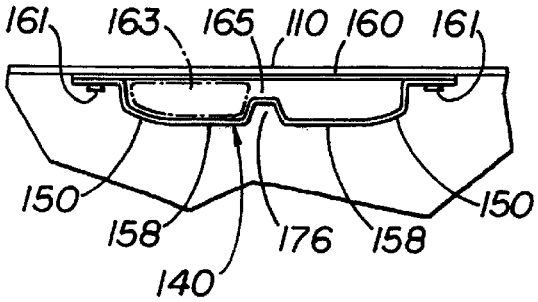
FIG. 6 is a side profile view of a heat transfer device according to the present invention.
Figure 7:
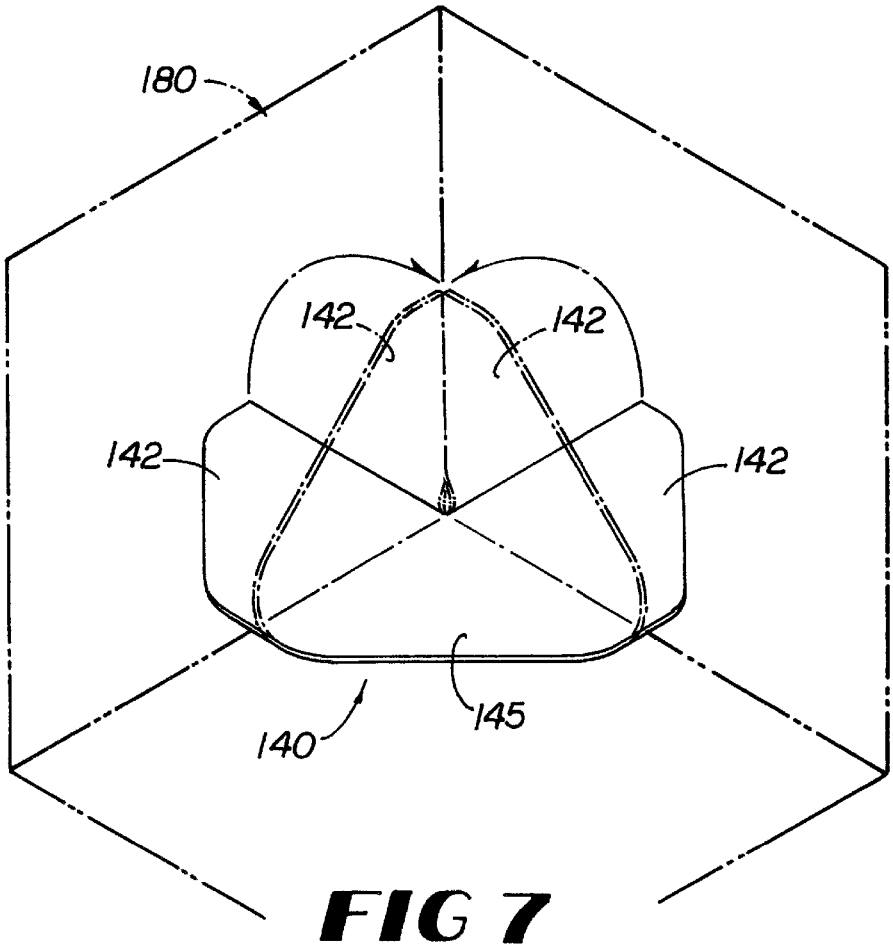
FIG. 7 shows a method of folding a flattened cornerpiece template into a cornerpiece heat transfer device according to the present invention.

As shown in FIG. 4B, the temperature control element can also take the form of a face area temperature control element 140'. The face area temperature control element 140' preferably comprises four of the generally triangular sub-sections thereby forming a generally square face geometry. Four containing means 141 form reservoirs for separately containing quantities of the first material and/or the second material, as described above. One or more face area temperature control elements 140' can be used in combination with, or instead of, the cornerpieces 140 described above.

The heat transfer devices of the present invention can further be provided with a small amount of sand, higher order olefin (e.g. C-30 or greater) or other inert means for enhancing nucleation, placed within the reservoirs containing the first and second materials. The sand, higher order olefin, or other inert means for nucleating is used to provide a convenient nucleation site in an otherwise smooth container. Such nucleation helps to prevent undesirable supercooling of the first or second material.

The present invention can also comprise one or more thermal inertia elements adapted to be placed in thermal contact with the payload. The initial temperature of the thermal inertia elements is preferably at or near the midpoint of the target temperature range, so that as heat transfer between the payload and the ambient occurs, the thermal inertia elements provide additional "thermal mass" to resist temperature change of the payload above or below the target temperature range. The thermal inertia elements can be water packs, gel packs, or virtually any other body having thermal mass. Preferably, the thermal inertia elements comprise one or more materials having a specific heat equal to or greater than that of the payload material. The materials of fabrication and the dimensions of the thermal inertia elements are selected to be compatible with the payload and the packaging materials.

One advantage of the above-described box-within-a-box system of the present invention is that the payload is surrounded by a temperature-controlled, circulating air stream, which enables more complete utilization of the heat transfer capacities of the system's temperature control materials, thereby improving the system's temperature control efficiency. This improved efficiency reduces the quantity of temperature control materials needed to maintain temperature control for a given time period or, conversely, extends the potential temperature control duration for a given quantity of materials. Because weight and volume are crucial concerns for express shipments, the present invention will provide reduced shipping costs as compared to less efficient systems. To enhance the temperature-controlled air stream circulation, the heat transfer devices are designed to leave air flow channels 131 between the outer housing 110 and the inner product carrying container 180. Air flow through these channels 131 enhances heat transfer between the first and/or second material within the heat transfer devices and the circulating air. In a further embodiment, one or more separating means 400 are provided for preventing direct contact between the heat transfer devices 140, 140' and the inner product carrying container 180. The separating means 400 can comprise one or more solution-free, raised protrusions on each of the generally triangular sub-sections of the heat transfer devices 140, 140'.

An alternate embodiment of the present invention provides very long storage times at selected temperatures. In this embodiment, one "inner" temperature control system is placed inside an "outer" system. For example, the inner system could consist of a fully functional 12 inch cube outer housing with a 1 inch thick insulating blanket and a 1 inch thick temperature control element, containing an 8 inch cube inner product carrying container (12 inches minus two sides of insulation or 2 inches, minus the thickness of two packs) for housing the payload. This entire inner system would then become the "payload" of the outer system, and be placed inside a 16 inch cube outer housing, again with 1 inch thick insulation and temperature control element thickness, yielding the desired 12 inch payload capacity. When the outer system finally fails due to heat transfer with the ambient, the inner system would see an ambient only slightly greater than its target temperature. Since the rate of heat transfer is directly proportional to the temperature difference, the innermost payload is maintained at the target temperature for extensive time periods.

Additional components that may comprise part of the system of the present invention include absorbent materials and a barrier bag. The barrier bag preferably comprises a sealable, flexible container of plastic or other leakproof material for containing the payload and preventing spillage or escape of any payload materials. Absorbent materials can be provided within the barrier bag, or within the inner product carrying container or the outer housing, to prevent spillage or escape of any free liquids within the insulating container.

The present invention further comprises a method for controlling the temperature of a payload within a temperature range, between a minimum temperature and a maximum temperature. The method of the present invention preferably generally comprises placing a first material having a first phase change temperature of approximately the minimum temperature, and a second material having a second phase change temperature of approximately the maximum temperature, into thermal contact with the payload materials. The first and second materials utilized in practicing the method of the present invention are as described above. This method can further comprise the use of the insulating container, heat transfer devices, and thermal inertia elements described herein. For example, the payload is placed in the inner product carrying container 180. If desired, thermal inertia elements are provided, and are inserted into the inner product carrying container 180 along with the payload. The inner product carrying container 180 is placed into the outer housing 110. One or more heat transfer devices separately containing quantities of the first and second materials, as described above, are placed between the inner product carrying container 180 and the outer housing 110. In this manner, the payload is insulated against heat transfer to or from the ambient by the outer housing 110, the heat transfer devices, and the inner product carrying container 180. Additionally, as more fully described above, the latent heats of transformation of the first and second materials provide additional resistance against temperature changes outside of the target temperature range. If provided, the additional thermal mass of the thermal inertia elements provides additional resistance to temperature changes. The method of the present invention thereby enables improved efficiency in the storage and transport of temperature sensitive materials.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A system for maintaining a payload within a temperature range, between a minimum temperature and a maximum temperature, the system comprising:

(a) a first material having a first phase change temperature of approximately the minimum temperature; and (b) a second material having a second phase change temperature of approximately the maximum temperature.

2. The system of claim 1, wherein said first material is a liquid within substantially all of the temperature range and changes to a solid at the first phase change temperature.

3. The system of claim 2, wherein said second material is a solid within substantially all of the temperature range and changes to a liquid at the second phase change temperature.

4. The system of claim 1, wherein the minimum temperature is 20° C. and the maximum temperature is 24° C., and wherein the first phase change temperature is between 16–20° C. and the second phase change temperature is between 24–26° C.

5. The system of claim 4, wherein the first material comprises n-hexadecane and the second material comprises n-octadecane.

6. The system of claim 1, wherein the minimum temperature is 4° C. and the maximum temperature is 6° C., and wherein the first phase change temperature is between 2–4° C. and the second phase change temperature is between 6–8° C.

7. The system of claim 1, wherein the minimum temperature is 17° C. and the maximum temperature is 19° C., and wherein the first phase change temperature is between 14–17° C. and the second phase change temperature is between 19–22° C.

8. The system of claim 7, wherein the first material comprises n-hexadecane and the second material comprises n-tetradecane.

9. The system of claim 1, further comprising an insulating container comprising:

(a) an outer housing defining a cavity therein;

(b) an inner product carrying container for receiving the payload, and capable of being disposed within the cavity of the outer housing;

(c) at least one heat transfer device for placement between said outer housing and said inner product carrying container, for separately containing a quantity of the first material and a quantity of the second material.

10. The system of claim 9, wherein the inner product carrying container comprises a box having an insulating shell.

11. The system of claim 9, further comprising at least one thermal inertia element for insertion within said inner product carrying container.

12. The system of claim 9, farther comprising an insulating material for insertion between said outer housing and said inner product carrying container.

13. The system of claim 9, wherein each of said at least one heat transfer devices comprise a flexible pouch.

14. The system of claim 9, wherein each of said at least one heat transfer devices comprise at least two reservoirs, a first reservoir containing a quantity of the first material and a second reservoir containing a quantity of the second material.

15. The system of claim 9, wherein each of said at least one heat transfer devices comprise a rigid or semirigid element having a sealable chamber formed therein.

16. The system of claim 9, wherein each of said at least one heat transfer devices comprise blister packs.

17. The system of claim 9, wherein said inner product carrying container comprises a box having corners, and wherein each said at least one heat transfer device comprises at least one generally pyramidal member having an inner surface and an outer surface, the inner surface defining a void for receiving a corner of the inner product carrying container.

18. The system of claim 9, wherein said outer housing, said inner product carrying container and said at least one heat transfer device comprise an inner temperature control system; said system further comprising an outer temperature control system comprising a second outer housing having a chamber therein for containing the inner temperature control system.

19. The system of claim 9, further comprising a barrier bag for surrounding the payload.

20. The system of claim 9, further comprising an absorbent material for absorbing any free liquids within said insulating container.

21. A heat transfer device comprising a quantity of a first material having a first phase change temperature, and a quantity of a second material having a second phase change temperature, wherein the second phase change temperature is greater than the first phase change temperature.

22. The heat transfer device of claim 21, wherein the first phase change temperature is between 16–20° C. and the second phase change temperature is between 24–26° C.

23. The heat transfer device of claim 21, wherein the first material comprises n-hexadecane and the second material comprises n-octadecane.

24. The heat transfer device of claim 21, wherein the first phase change temperature is between 2–4° C. and the second phase change temperature is between 6–8° C.

25. The heat transfer device of claim 21, wherein the first phase change temperature is between 14–17° C. and the second phase change temperature is between 19–22° C.

26. The heat transfer device of claim 21, wherein the first material comprises n-hexadecane and the second material comprises n-tetradecane.

27. A method for controlling the temperature of a payload within a temperature range, between a minimum temperature and a maximum temperature, the method comprising:

(a) placing a first material having a first phase change temperature of approximately the minimum temperature in thermal contact with the payload; and (b) placing a second material having a second phase change temperature of approximately the maximum temperature in thermal contact with the payload.

28. The method of claim 27, wherein the minimum temperature is 20° C. and the maximum temperature is 24° C., and wherein the first phase change temperature is between 16–20° C. and the second phase change temperature is between 24–26° C.

29. The method of claim 28, wherein the first material comprises n-hexadecane and the second material comprises n-octadecane.

30. The method of claim 27, wherein the minimum temperature is 4° C. and the maximum temperature is 6° C., and wherein the first phase change temperature is between 2–4° C. and the second phase change temperature is between 6–8° C.

31. The method of claim 27, wherein the minimum temperature is 17° C. and the maximum temperature is 19° C., and wherein the first phase change temperature is between 14–17° C. and the second phase change temperature is between 19–22° C.

32. The method of claim 31, wherein the first material comprises n-hexadecane and the second material comprises n-tetradecane.

33. The method of claim 27, further comprising:

(a) placing the payload in an inner product carrying container;

(b) placing the inner product carrying container in an outer housing;

(c) placing at least one heat transfer device between said outer housing and said inner product carrying container, the at least one heat transfer device comprising a quantity of the first material and a quantity of the second material.

34. The method of claim 33, further comprising placing at least one thermal inertia element within said inner product carrying container.

35. The method of claim 33, further comprising providing an insulating material between said outer housing and said inner product carrying container.

* * * * *